US011437200B2

(12) United States Patent
Bonfanti et al.

(10) Patent No.: US 11,437,200 B2
(45) Date of Patent: Sep. 6, 2022

(54) LOW VOLTAGE CONTACT ASSEMBLY

(71) Applicant: ABB S.p.A., Milan (IT)

(72) Inventors: Marco Bonfanti, Presezzo (IT); Mauro Ghislotti, Mapello (IT); Michele Ceroni, Bedulita (IT)

(73) Assignee: ABB S.P.A., Milan (IT)

( * ) Notice: Subject to any disclaimer, the term of this patent is extended or adjusted under 35 U.S.C. 154(b) by 0 days.

(21) Appl. No.: 16/887,378

(22) Filed: May 29, 2020

(65) Prior Publication Data

US 2020/0381188 A1 Dec. 3, 2020

(30) Foreign Application Priority Data

May 29, 2019 (EP) ..... 19177384

(51) Int. Cl.
*H01H 1/20* (2006.01)
*H01H 1/22* (2006.01)
*H01H 73/04* (2006.01)

(52) U.S. Cl.
CPC ..... *H01H 1/2041* (2013.01); *H01H 1/221* (2013.01); *H01H 73/04* (2013.01); *H01H 2001/223* (2013.01)

(58) Field of Classification Search
CPC ..... H01H 1/2041; H01H 1/221; H01H 1/205; H01H 1/5822; H01H 3/32; H01H 73/04; H01H 73/045; H01H 9/30; H01H 9/346; H01H 9/362
USPC .... 200/238, 236, 48 A, 244; 218/31, 32, 33, 218/110; 335/16
See application file for complete search history.

(56) References Cited

U.S. PATENT DOCUMENTS 5,281,776 A * 1/1994 Morel ..... H01H 71/1009 218/152
5,310,971 A * 5/1994 Vial ..... H01H 1/205 200/244
5,886,311 A 3/1999 Morel et al.
(Continued)

FOREIGN PATENT DOCUMENTS

CN 1198303 C 4/2005
WO 02052597 A1 7/2002
WO 2012083829 A1 6/2012

OTHER PUBLICATIONS

European Patent Office, Extended Search Report issued in corresponding Application No. 19177384.5, dated Oct. 16, 2019, 5 pp.
(Continued)

*Primary Examiner* — William A Bolton
(74) *Attorney, Agent, or Firm* — Greenberg Traurig, LLP

(57) ABSTRACT

A low voltage contact assembly including a rotating support having a body adapted to rotate around a rotation axis and supporting at least a first couple of movable contacts that can be coupled to/uncoupled from corresponding first fixed contacts by rotation around said rotation axis. The first couple of movable contacts include a first and a second movable contacts housed in the rotating support. The low voltage assembly further includes a pressure exerting device having a pressing bar operatively coupled to the first and second elongated contact body and transversally placed with respect to the rotation plane of the first and second elongated contact bodies.

16 Claims, 7 Drawing Sheets

(56) References Cited

U.S. PATENT DOCUMENTS

| | | | | |
|---|---|---|---|---|
| 6,590,173 | B2 * | 7/2003 | Uchida | H01H 1/205 200/244 |
| 6,989,501 | B2 * | 1/2006 | Carrara | H01H 1/2066 200/400 |
| 7,005,594 | B2 * | 2/2006 | Kim | H01H 1/205 200/244 |
| 7,116,194 | B2 * | 10/2006 | Azzola | H01H 1/2058 335/202 |
| 7,221,246 | B2 * | 5/2007 | Rajauria | H01H 1/205 335/16 |
| 7,977,592 | B2 * | 7/2011 | Shmukler | H01H 1/205 200/244 |
| 9,293,271 | B2 * | 3/2016 | Biedunkiewicz | H01H 1/205 |
| 9,330,859 | B2 * | 5/2016 | Biedunkiewicz | H01H 3/32 |
| 2006/0119455 | A1 * | 6/2006 | Park | H01H 77/104 335/16 |
| 2011/0266121 | A1 * | 11/2011 | Bonetti | H01H 1/225 200/275 |

OTHER PUBLICATIONS

Indian Patent Office, Examination Report issued in corresponding Application No. 202044021638, dated May 10, 2021, 4 pp.

* cited by examiner

LOW VOLTAGE CONTACT ASSEMBLY

The present invention relates to a low voltage contact assembly for a low voltage switching device, and in particular for a low voltage circuit breaker. More in particular, the present invention relates to a low voltage contact assembly with a double movable contact arrangement. It is known that in the low voltage field, the switching devices, and in particular the circuit breakers, are generally provided with a contact assembly comprising a movable contact and a fixed contact that can be coupled to and uncoupled from one another. The low voltage switching devices of the known art also comprise control means that cause relative movement of said movable contact with respect to the fixed contact, so that they can assume at least one first, coupling, position (circuit closed) and one second, separation, position (circuit open).

It is known in the low voltage field that for certain applications it is desirable to have a double movable contact so as to split the current in two parallel paths at the contact points. Moreover, it is also known that in certain cases it is desirable to have a contact assembly having a double interruption configuration, i.e. having two separated locations in which two separate sets of movable contact and fixed contact open/close the circuit simultaneously.

The known solutions for configurations with a double movable contact, even if suitable for the needs, have a number of drawbacks and disadvantages.

A major problem derives from wearing phenomena and mechanical stresses which generate a situation of non-co-planarity in correspondence of the contact surfaces between the movable contact and the fixed contact.

This situation is represented in the attached FIGS. 7 and 8, which respectively shows a conventional double movable contact arrangement under normal conditions and under wearing conditions.

With reference to FIG. 7, a conventional contact assembly 500 generally comprise a couple of movable contacts having corresponding contact end 711 and 721 which can be coupled to/uncoupled from a corresponding fixed contacts 51. Under normal conditions and in the closed positions, a pressing bar 501 exert a uniform pressure on the contact end 711 and 721.

With reference to FIG. 8, in case of, e.g., excessive or non-uniform wearing of the contacts, a situation of non-co-planarity is generated in correspondence of the contact surfaces between the movable contacts 711, 721 and the fixed contact 51. Thus, in such a case, as shown by the arrows 510, the pressure exerted by the pressing bar 501 is not uniformly distributed and the current also flows in an unbalanced way between the movable contacts 711, 721 and the fixed contact 51. On the basis of the above considerations, there is clearly a need to have available alternative technical solutions that will enable the limits and the problems set forth above to be overcome. Hence, the present disclosure is aimed at providing a low voltage contact assembly, in particular a low voltage contact assembly with a double movable contact, which allows overcoming at least some of the above-mentioned shortcomings.

In particular, the present invention is aimed at providing a low voltage contact assembly, which is able to compensate possible situation of non co-planarity in correspondence of the contact surfaces.

Furthermore, the present invention is aimed at providing a low voltage contact assembly, which allows minimizing the negative consequences of wearing phenomena of the contact surfaces. Moreover, the present invention is aimed at providing a low voltage contact assembly, in particular a low voltage contact assembly with a double movable contact, in which the contact pressure can be distributed substantially uniformly on the movable contacts, also in the presence of wearing phenomena of the contact surfaces.

Also, the present invention is aimed at providing a low voltage contact assembly, in particular a low voltage contact assembly with a double movable contact, that is reliable and relatively easy to be manufactured out and at competitive costs.

Thus, the present invention relates to a low voltage contact assembly which comprises a rotating support having a body adapted to rotate around a rotation axis and supporting at least a first couple of movable contacts that can be coupled to/uncoupled from corresponding first fixed contacts by rotation around said rotation axis, said first couple of movable contacts comprising a first and a second movable contacts housed in said rotating support and each having a corresponding first and second elongated contact body with a contact end protruding from said rotating support, said first and second elongated contact bodies lying parallel to each other in a rotation plane substantially perpendicular to said rotation axis.

The low voltage contact assembly according to the present disclosure is characterized in that it further comprises a pressure exerting device having a pressing bar operatively coupled to said first and second elongated contact body and transversally (e.g. perpendicularly) placed with respect to said rotation plane of said first and second elongated contact bodies, and a first and a second elastic elements positioned at opposite ends of said pressing bar, said pressing bar further comprising a first and a second operating surface each comprising a corresponding first and second pressing surface protruding from said pressing bar and respectively acting on said first and second elongated contact body As better explained in the following description, the low voltage contact assembly as disclosed herein allows avoiding, or at least greatly reducing, the above-mentioned problems.

In practice, as better described hereinafter, it has been seen that the particular configuration of the pressing bar, and of its first and second operating surfaces with the first and second corresponding pressing surfaces protruding from the pressing bar, allows obtaining a much more uniform distribution of the pressing force in the closed contact situation, even in the presence of wearing phenomena and mechanical stresses relatively relevant.

In a typical embodiment of the low voltage contact assembly, according to the present invention, said first and second elastic elements of said pressure exerting device each have a first end which is fixed on said rotating support and a second end which acts on said pressing bar.

For instance, in an exemplary embodiment of the low voltage contact assembly of the present disclosure, said first and second elastic elements can respectively comprise a first and a second spring each having a first end fixed on said rotating support and a second end acting on said pressing bar.

Moreover, said first and second elastic elements of said pressure exerting device can be made as a single body with said pressing bar or can be separated elements which cooperate as described herein.

In particular, the first and second elastic elements can conveniently be coupled to said pressing bar by inserting their second end into corresponding first and second seats positioned on said pressing bar.

In a general embodiment of the low voltage contact assembly, according to the present invention, said pressing bar is advantageously a substantially cylindrical bar which is transversally positioned in said rotating support with respect to said first and second elongated contact bodies According to a first preferred embodiment of the low voltage contact assembly, according to the present invention, said first and second pressing surface are curved surfaces which symmetrically protrude from said pressing bar.

In an alternative embodiment of the presently disclosed ow voltage contact assembly, said first and second pressing surface are curved surfaces asymmetrically protruding from at least a portion of said pressing bar.

In such a case, in a particular embodiment of the presently disclosed low voltage contact assembly, said first and second pressing surface can be conveniently formed as cam-shaped surfaces protruding from said pressing bar.

The low voltage contact assembly can be conveniently used for single interruption application as well as for double interruption applications.

In the latter case, the low voltage contact assembly, according to the present invention, advantageously comprises a second couple of movable contacts that can be coupled to/uncoupled from corresponding second fixed contacts by rotation around said rotation axis. Said second couple of movable contacts generally comprises a third and a fourth movable contacts which are housed in said rotating support. Each of said third and fourth movable contact advantageously comprises a corresponding third and fourth elongated contact body having a contact end which protrudes from said rotating support. Said third and fourth elongated contact bodies are placed parallel to each other in a rotation plane which is substantially perpendicular to said rotation axis.

In practice, in a typical embodiment of a low voltage contact assembly for double interruption applications, said first and second couple of movable contacts are conveniently substantially identical to each other and are symmetrically positioned with respect to said rotation axis.

According to known embodiments in the field of the double interruption technologies, said first and third elongated contact bodies are conveniently made in a single piece and said second and fourth elongated contact bodies are also made in a single piece.

In a further aspect, the present invention also relates to a low voltage switching pole comprising a low voltage contact assembly as described herein, as well as to a low voltage switching device, and in particular to a low voltage circuit breaker, comprising a low voltage contact assembly as disclosed herein.

Further features and advantages of the present invention will be more clear from the description of preferred but not exclusive embodiments of the low voltage contact assembly of the present invention, and in particular of a low voltage contact assembly with a double movable contact, shown by way of examples in the accompanying drawings, wherein.

With reference to the attached figures a low voltage contact assembly 1, 10 of the present invention in its more general definition comprises a rotating support 2 which has a body 21 adapted to rotate around a rotation axis 100.

Figure 1:
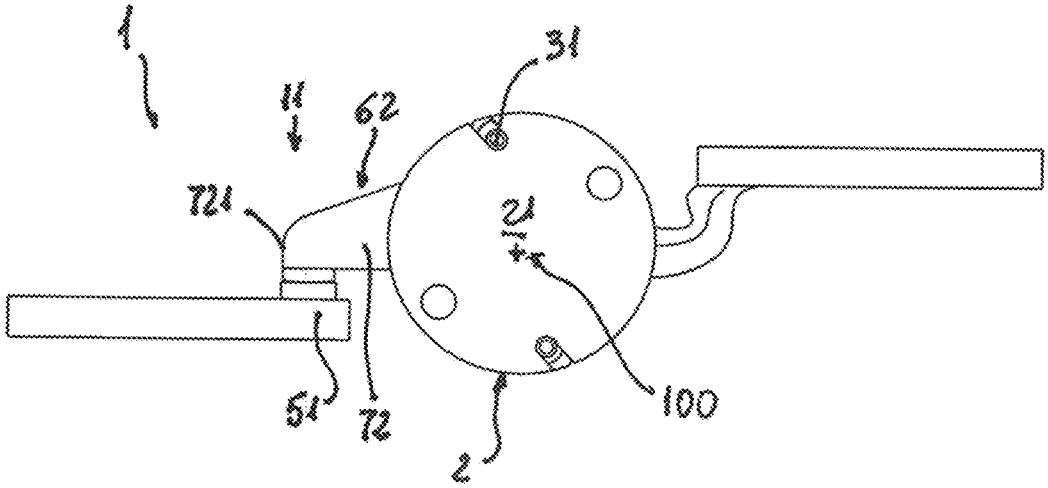
FIG. 1 is a side view of a first embodiment of a low voltage contact assembly according to the present invention.
Figure 2:
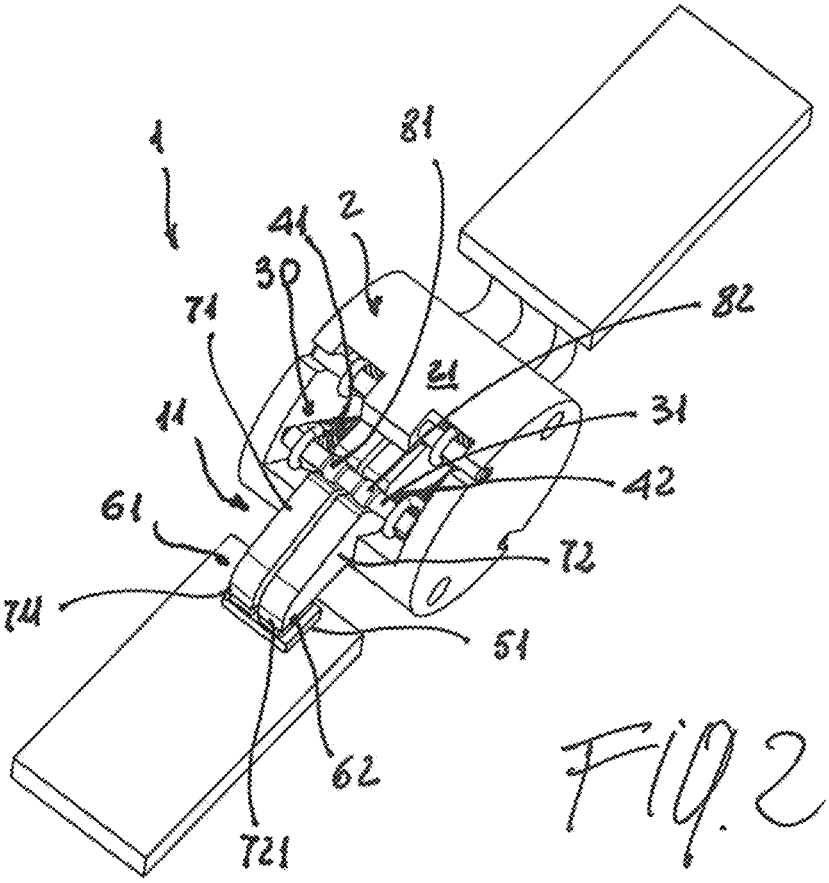
FIG. 2 is a perspective view of a first embodiment of a low voltage contact assembly according to the present invention.

In the single interruption configuration of FIGS. 1 and 2, the body 21 supports at least a first couple 11 of movable contacts that can be coupled to/uncoupled from corresponding first fixed contacts 51 by rotation around said rotation axis 100.

In particular, the first couple 11 of movable contacts normally comprises a first 61 and a second 62 movable contacts which are housed in said rotating support 2. According to known embodiments, the first 61 and a second 62 movable contacts have a corresponding first 71 and second 72 elongated contact body with a contact end 711, 721 protruding from the rotating support 2.

The first 71 and second 72 elongated contact bodies are positioned parallel to each other in a rotation plane which is substantially perpendicular to said rotation axis 100 and can rotate between a closed position (shown in the figures) and an open position (not shown).

Figure 3:
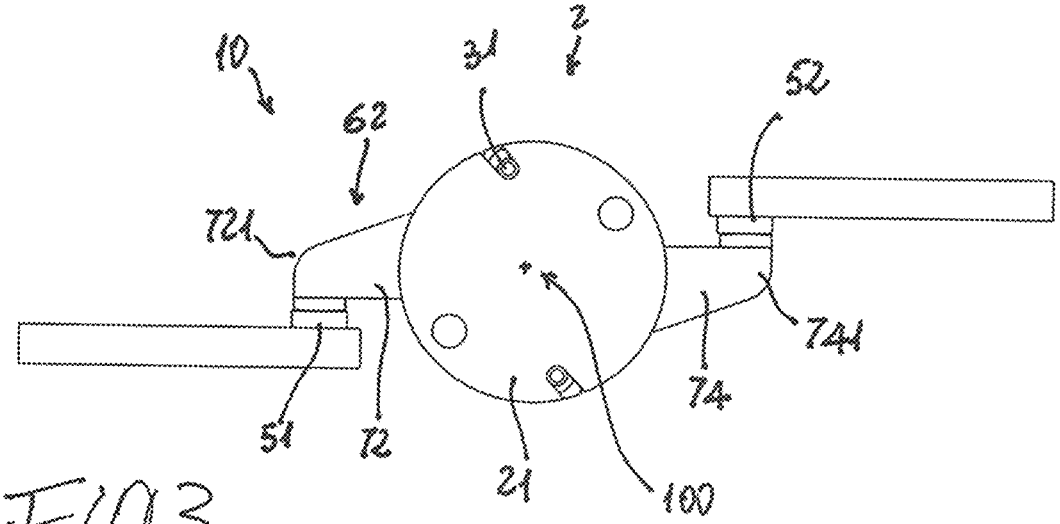
FIG. 3 is a side view of a second embodiment of a low voltage contact assembly according to the present invention.
Figure 4:
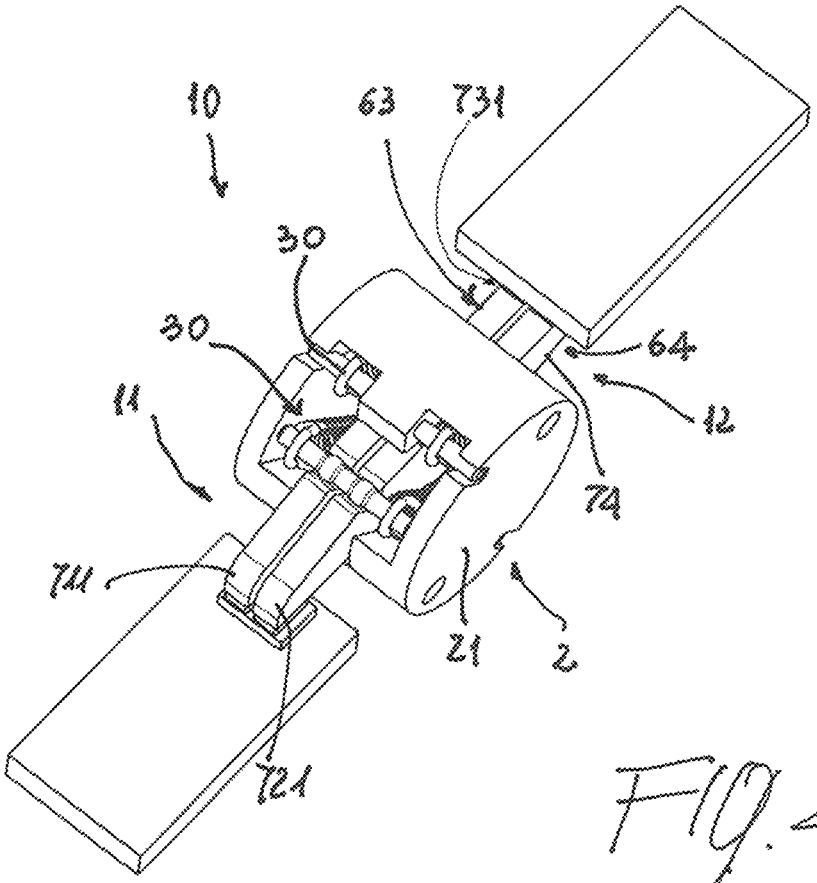
FIG. 4 is a perspective view of a second embodiment of a low voltage contact assembly according to the present invention.

With reference to FIGS. 3 and 4, in case of double interruption applications, the low voltage contact assembly 10, according to the present invention, comprises a second couple 12 of movable contacts that can be coupled to/uncoupled from corresponding second fixed contacts 52 by rotation around said rotation axis 100.

The second couple 12 of movable contacts is also supported by the body 21 of the rotating support 2 and comprises a third 63 and a fourth 64 movable contacts which are housed in said rotating support 2.

The third 63 and fourth 64 movable contacts each has a corresponding third 73 and fourth 74 elongated contact body with a contact end 731, 741 that protrudes from said rotating support 2.

The third 73 and fourth 74 elongated contact bodies are positioned parallel to each other in a rotation plane which is substantially perpendicular to said rotation axis 100, and can rotate together with the first 71 and second 72 elongated contact bodies between a closed position (shown in the figures) and an open position (not shown).

According to embodiments known for double interruption applications, in preferred embodiments of the low voltage contact assembly 10 the first 11 and second 12 couple of movable contacts are identical to each other and are symmetrically positioned with respect to said rotation axis 100, as shown in FIGS. 3 and 4.

More in particular, according to embodiments known for double interruption applications, the first 71 and third 73 elongated contact bodies are conveniently made in a single piece and the second 72 and fourth 74 elongated contact bodies are also conveniently made in a single piece.

One of the particular features of the low voltage assembly 1, 10 according to the present invention is given by the fact that it further comprises a pressure exerting device 30 having a pressing bar 31, 32, 33, 34 of possible different shapes that is operatively coupled to said first 71 and second 72 elongated contact body.

As shown in the attached figures, the pressing bar 31, in typical embodiments of the low voltage assembly 1, 10, is transversally placed with respect to the rotation plane of said first 71 and second 72 elongated contact bodies, and in case of double interruption applications, it is transversally placed also with respect to the rotation plane of said third 73 and fourth 74 elongated contact bodies.

The pressure exerting device 30 is further provided with a first 41, 411 and a second 42, 421 elastic elements which are positioned at opposite ends of said pressing bar 31, 32, 33, 34.

A further particular features of the low voltage assembly 1, 10 according to the present invention is given by the fact that said pressing bar 31, 32, 33, 34 further comprising a first and a second operating surface each comprising a corresponding first 81, 811 and second 82, 821 pressing surface protruding from said pressing bar 31, 32, 33, 34.

The first 81, 811 and second 82, 821 pressing surfaces respectively act on said first 71 and second 72 elongated contact body, so as to compensate possible variation of planarity in the contact surface regions by maintaining a substantially balanced pressing force the first 71 and second 72 elongated contact body.

Figure 5:
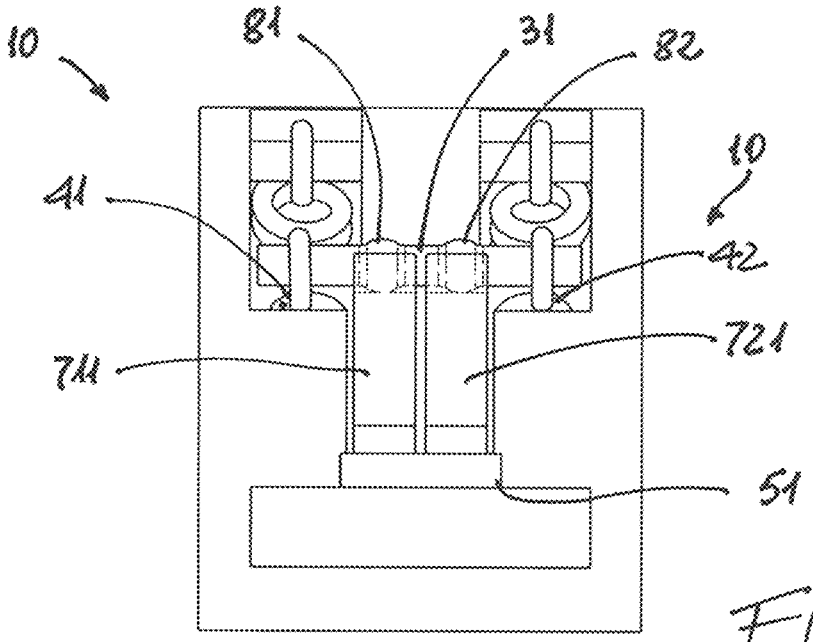
FIG. 5 is a schematic view of an embodiment of a low voltage contact assembly according to the present invention, shown in the closed position under normal conditions.
Figure 6:
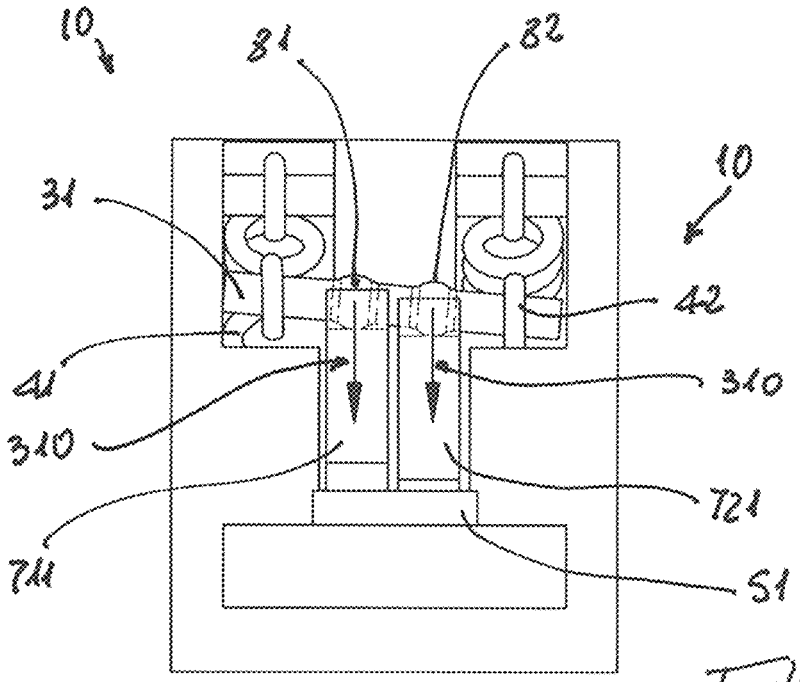
FIG. 6 is a schematic view of an embodiment of a low voltage contact assembly according to the present invention, shown in the closed position under contact wearing conditions.

The behavior of the presently disclosed low voltage contact assembly is represented in the attached FIGS. 5 and 6, which respectively shows double movable contact arrangement according to the invention under normal conditions and under wearing conditions.

With reference to FIG. 5, the low voltage contact assembly 10 according to the invention, comprise a couple of movable contacts having corresponding contact end 711 and 721 which can be coupled to/uncoupled from a corresponding fixed contacts 51. Under normal conditions and in the closed positions, the pressing bar 31 exert a uniform pressure generated by the springs 41 and 42 on the contact end 711 and 721.

Figure 7:
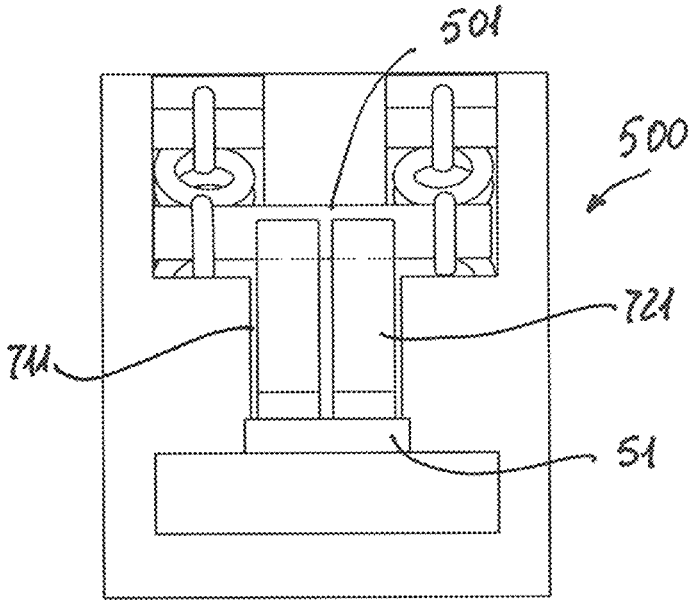
FIG. 7 is a schematic view of an embodiment of a conventional low voltage contact assembly, shown in the closed position under normal conditions.
Figure 8:
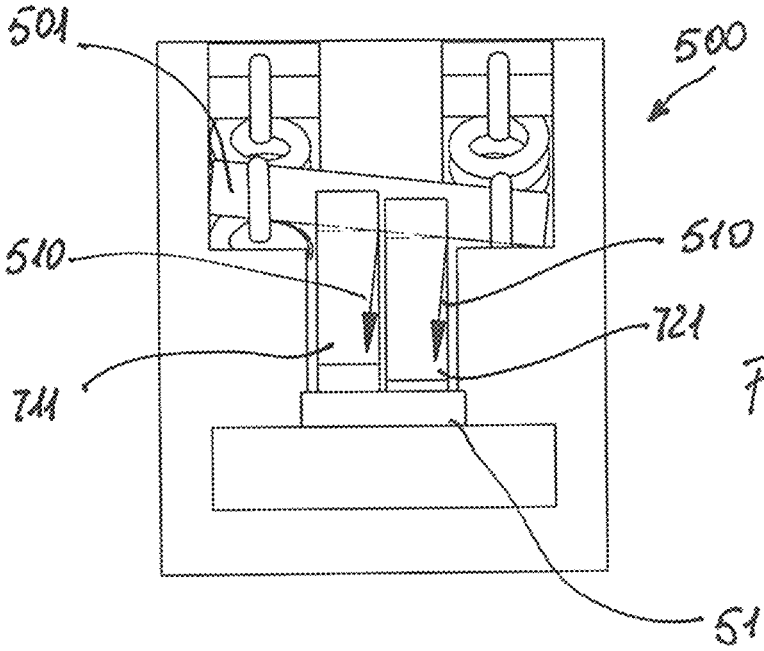
FIG. 8 is a schematic view of an embodiment of a conventional low voltage contact assembly, shown in the closed position under contact wearing conditions.
Figure 9:
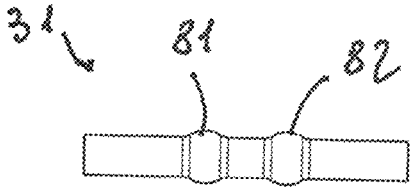
FIG. 9 is a front view of a first embodiment of a component of a low voltage contact assembly according to the present invention.

Differently from the situation of FIGS. 7 and 8, where the pressing bar is substantially cylindrical, in the low voltage contact assembly of the present invention the pressing bar 31 is provided with first 81 and second 82 pressing surfaces that protrudes from the pressing bar 31 and act on said first 71 and second 72 elongated contact body.

As shown in FIG. 6, in case of, e.g., excessive or non-uniform wearing of the contacts, a situation of non-coplanarity is generated in correspondence of the contact surfaces between the movable contacts 711, 721 and the fixed contact 51. In such a case, the different heights due to the lack of planarity is compensated by the balancing effect of the first 81 and second 82 pressing surfaces having a rounded profile that allows keeping the pressure exerted by the pressing bar 31 is uniformly distributed on the movable contacts ends 711, 721, as shown by the arrows 310, thereby overcoming the problems of the known art.

Typically, said first 41 and second 42 elastic elements each have a first end fixed on said rotating support 2 and a second end acting on said pressing bar 31.

The first 41 and second 42 elastic elements can be for instance a first and a second spring each having a first end fixed on said rotating support 2 and a second end acting on said pressing bar 31.

Figure 10:
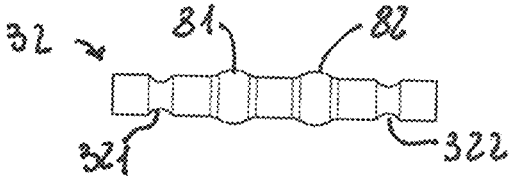
FIG. 10 is a front view of a second embodiment of a component of a low voltage contact assembly according to the present invention.

Preferably, as shown in FIG. 10, the pressing bar 32 can conveniently comprise a first 321 and a second 322 seat for housing said second end of said first 41 and second 42 elastic elements, respectively.

The first 81 and second 82 pressing surface are generally curved surfaces protruding from the pressing bar.

As shown in FIGS. 13-6, 9-10 and 12 said first 81 and second 82 pressing surface are curved surfaces symmetrically protruding from said pressing bar 31, 32, 34.

Figure 11:
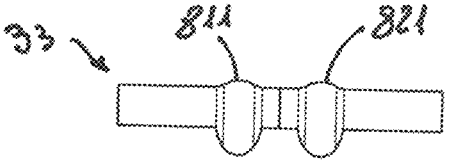
FIG. 11 is a front view of a third embodiment of a component of a low voltage contact assembly according to the present invention.

Alternatively, as shown in FIG. 11, said first 811 and second 821 pressing surface can be cam-shaped surfaces protruding from said pressing bar 33, and, in general, the first 811 and second 821 pressing surface can be curved surfaces asymmetrically protruding from at least a portion of said pressing bar 33.

Figure 12:
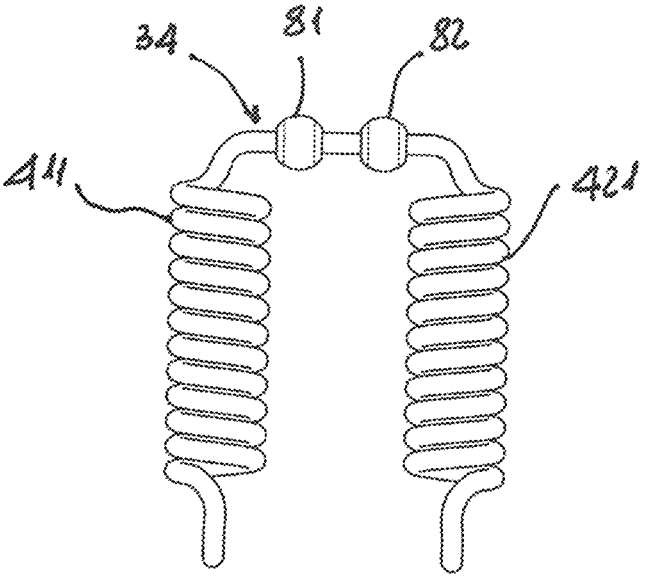
FIG. 12 is a front view of a fourth embodiment of a component of a low voltage contact assembly according to the present invention.

In general, in the pressure exerting device 30 the pressing bar 31, 32, 33 and the first 41 and second 42 elastic elements are made as separate elements operatively coupled. However, as shown in FIG. 12, I a possible embodiment of a low voltage contact assembly according to the invention said pressing bar 34 and said first 411 and second 421 elastic elements of said pressure exerting device 30 can be made as a single body.

Figure 13:
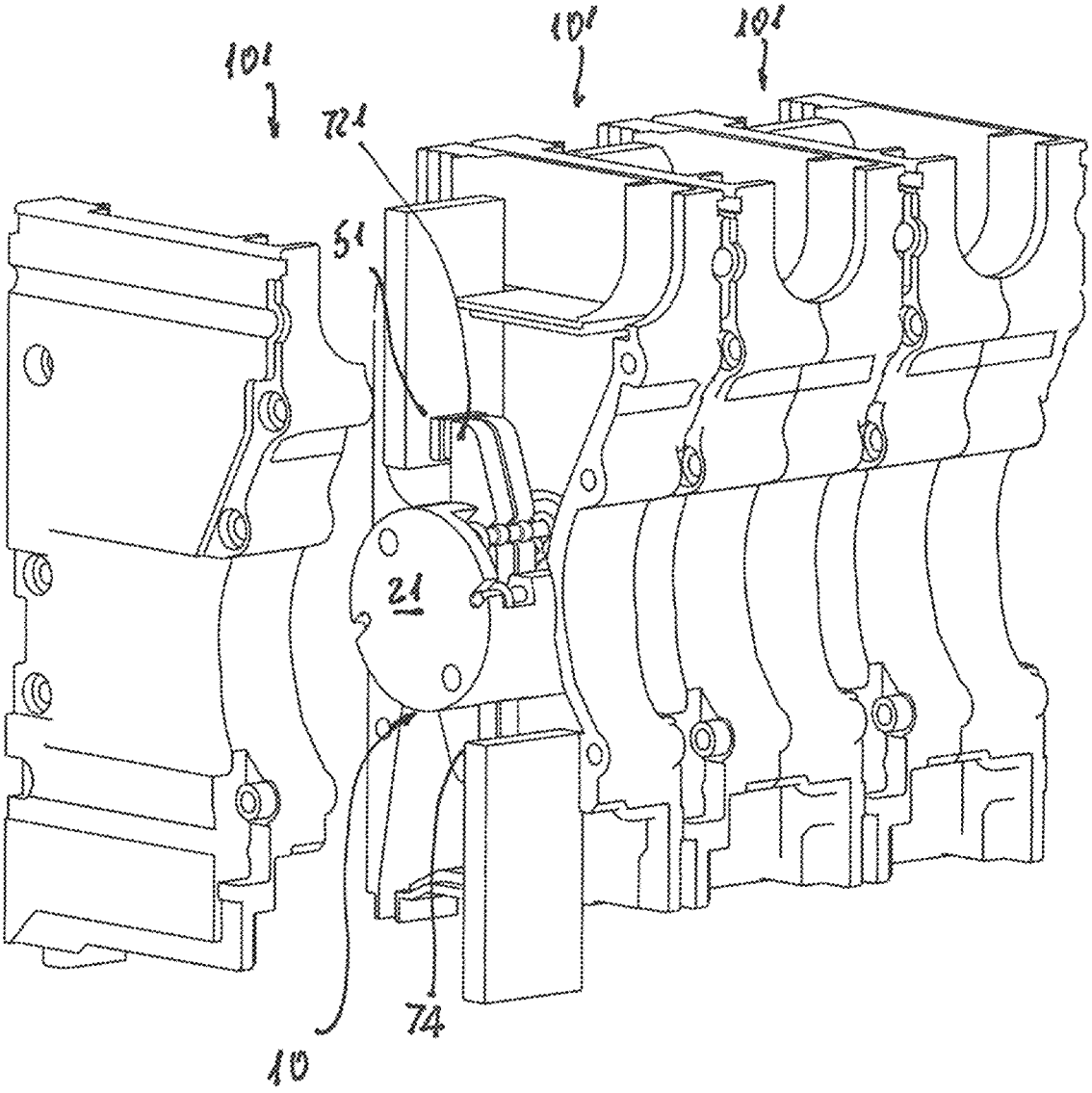
FIG. 13 is a perspective view of a low voltage switching pole including a low voltage contact assembly according to the present invention.

In a further aspect, with reference to FIG. 13, the present invention also relates to a low voltage switching pole 101 which comprises a low voltage contact assembly 1, 10 as previously disclosed.

Figure 14:
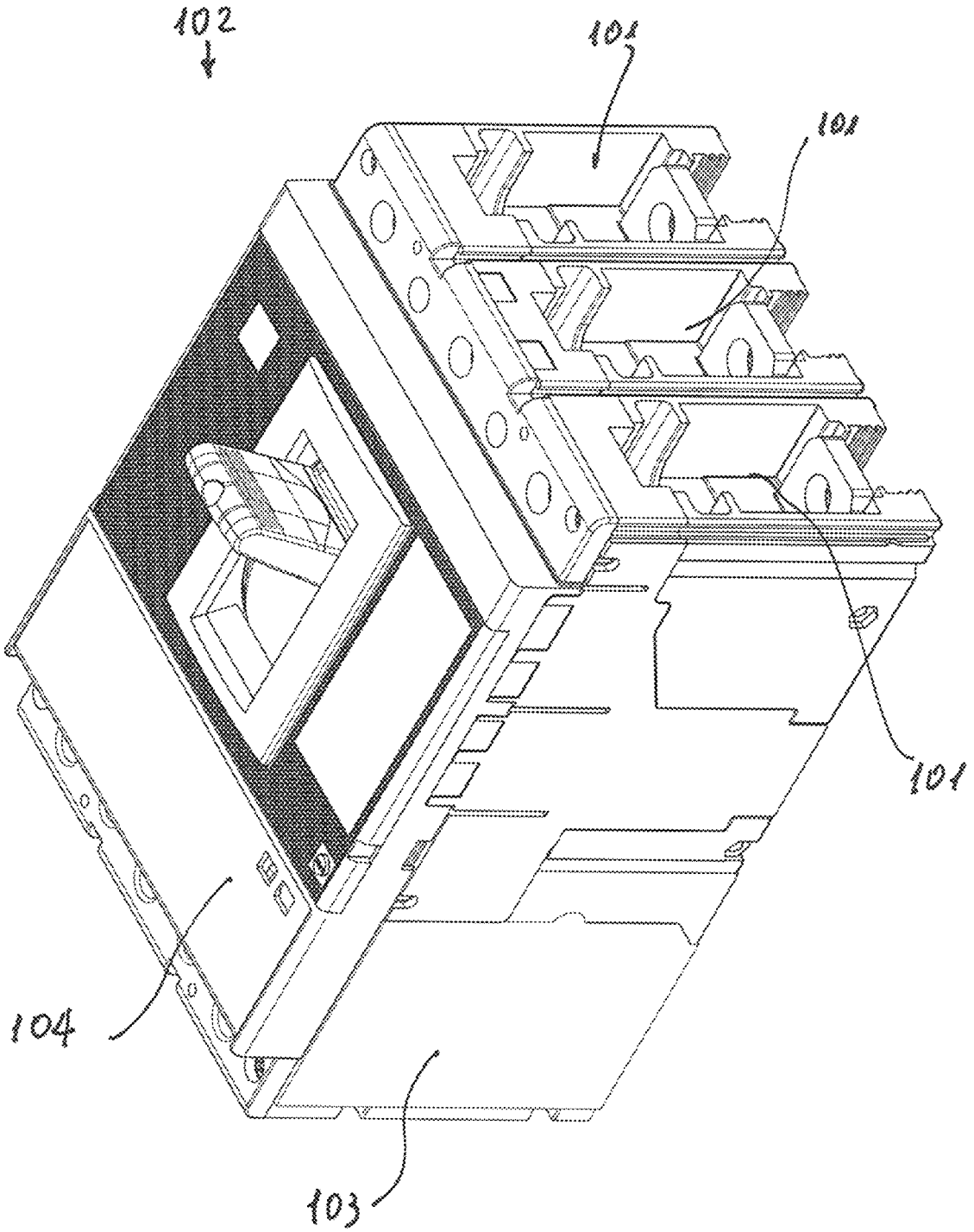
FIG. 14 is a perspective view of a low voltage circuit breaker including a low voltage contact assembly according to the present invention.

Furthermore, with reference to FIG. 14, the present invention also relates to a low voltage switching device, and in particular a voltage circuit breaker 102 which comprises a low voltage contact assembly as previously disclosed. In the embodiment shown, the circuit breaker 102 comprises a casing 103 having a cover 104. Inside the casing 103 there are a number of low voltage poles which house a corresponding low voltage contact assembly as disclosed herein.

It is clear from the above that the low voltage switching device of the present invention allows solving the previously underlined technical problems.

Several variations can be made to the low voltage switching device thus conceived, all falling within the scope of the attached claims. In practice, the materials used and the contingent dimensions and shapes can be any, according to requirements and to the state of the art.

The invention claimed is:

1. A low voltage contact assembly comprising a rotating support having a body adapted to rotate around a rotation axis and supporting at least a first couple of movable contacts that can be couple to/uncoupled from corresponding first fixed contacts by rotation around said rotation axis, said first couple of movable contacts comprising a first and a second movable contacts housed in said rotating support and each having a corresponding first and second elongated contact body with a contact end protruding from said rotating support, said first and second elongated contact bodies lying parallel to each other in a rotation plane substantially perpendicular to said rotation axis, said low voltage assembly comprising a pressure exerting device having a pressing bar operatively coupled to said first and second elongated contact body and transversally placed with respect to said rotation plane of said first and second elongated contact bodies, and a first and a second elastic elements positioned at opposite ends of said pressing bar, said pressing bar comprising a first and a second operating surface each comprising a corresponding first and second pressing surface protruding from said pressing bar and respectively acting on said first and second elongated contact body, wherein said first and second pressing surface are cam-shaped surfaces symmetrically protruding from said pressing bar and wherein said first and second elastic elements each have a first end fixed on said rotating support and a second end acting on said pressing bar.

2. The low voltage contact assembly, according to claim 1, wherein said first and second pressing surface are curved surfaces symmetrically protruding from said pressing bar.

3. The low voltage contact assembly, according to claim 1, wherein said first and second pressing surface are curved surfaces asymmetrically protruding from at least a portion of said pressing bar.

4. The low voltage contact assembly, according to claim 1, wherein said pressing bar is a substantially cylindrical bar transversally positioned in said rotating support with respect to said first and second elongated contact bodies.

5. The low voltage contact assembly, according to claim 1, wherein said pressing bar comprises a first and a second seat for said second end of said first and second elastic elements, respectively.

6. The low voltage contact assembly, according to claim 1, wherein said first and second elastic elements respectively comprise a first and a second spring each having a first end fixed on said rotating support and a second end acting on said pressing bar.

7. The low voltage contact assembly, according to claim 1, wherein said pressing bar and said first and second elastic elements of said pressure exerting device are a single body.

8. The low voltage contact assembly, according to claim 1, further comprising a second couple of movable contacts that can be coupled to/uncoupled from corresponding second fixed contacts by rotation around said rotation axis, said second couple of movable contacts comprising a third and a fourth movable contacts housed in said rotating support and each having a corresponding third and fourth elongated contact body with a contact end protruding from said rotating support, said third and fourth elongated contact bodies lying parallel to each other in a rotation plane substantially perpendicular to said rotation axis.

9. The low voltage contact assembly, according to claim 8, wherein said first and second couple of movable contacts are identical to each other and symmetrically positioned with respect to said rotation axis.

10. The low voltage contact assembly, according to claim 9, wherein said first and third elongated contact bodies are made in a single piece and said second and fourth elongated contact bodies are made in a single piece.

11. The low voltage contact assembly, according to claim 8, wherein said first and third elongated contact bodies are made in a single piece and said second fourth elongated contact bodies are made in a single piece.

12. A low voltage switching pole comprising the low voltage contact assembly according to claim 1.

13. A low voltage switching device comprising the low voltage contact assembly according to claim 1.

14. A low voltage circuit breaker comprising the low voltage contact assembly according to claim 1.

15. A low voltage contact assembly comprising a rotating support having a body adapted to rotate around a rotation axis and supporting at least a first couple of movable contacts that can be couple to/uncoupled from corresponding first fixed contacts by rotation around said rotation axis, said first couple of movable contacts comprising a first and a second movable contacts housed in said rotating support and each having a corresponding first and second elongated contact body with a contact end protruding from said rotating support, said first and second elongated contact bodies lying parallel to each other in a rotation plane substantially perpendicular to said rotation axis, said low voltage assembly comprising a pressure exerting device having a pressing bar operatively coupled to said first and second elongated contact body and transversally placed with respect to said rotation plane of said first and second elongated contact bodies, and a first and a second elastic elements positioned at opposite ends of said pressing bar, said pressing bar comprising a first and a second operating surface each comprising a corresponding first and second pressing surface protruding from said pressing bar and respectively acting on said first and second elongated contact body, wherein said first and second pressing surface are cam-shaped surfaces protruding from said pressing bar.

16. A low voltage contact assembly comprising a rotating support having a body adapted to rotate around a rotation axis and supporting at least a first couple of movable contacts that can be couple to/uncoupled from corresponding first fixed contacts by rotation around said rotation axis, said first couple of movable contacts comprising a first and a second movable contacts housed in said rotating support and each having a corresponding first and second elongated contact body with a contact end protruding from said rotating support, said first and second elongated contact bodies lying parallel to each other in a rotation plane substantially perpendicular to said rotation axis, said low voltage assembly comprising a pressure exerting device having a pressing bar operatively coupled to said first and second elongated contact body and transversally placed with respect to said rotation plane of said first and second elongated contact bodies, and a first and a second elastic elements positioned at opposite ends of said pressing bar, said pressing bar comprising a first and a second operating surface each comprising a corresponding first and second pressing surface protruding from said pressing bar and respectively acting on said first and second elongated contact body, wherein said first and second pressing surface are curved surfaces asymmetrically protruding from at least a portion of said pressing bar.

* * * * *